United States Patent [19]

Hutchinson

[11] Patent Number: 4,615,271

[45] Date of Patent: Oct. 7, 1986

[54] SHOCK-AUGMENTING CHARGE WITH AXIALLY-GROOVED BOOSTER HOUSING

[75] Inventor: Christopher D. Hutchinson, Tonbridge, England

[73] Assignee: Royal Ordnance plc, London, England

[21] Appl. No.: 757,473

[22] Filed: Jul. 22, 1985

[30] Foreign Application Priority Data

Jul. 31, 1984 [GB] United Kingdom ..... 8419461

[51] Int. Cl.[4] ..... F42B 3/00

[52] U.S. Cl. ..... 102/318; 102/322; 102/331; 102/332; 102/275.4; 102/275.11

[58] Field of Search ..... 102/275.4, 275.8, 318, 102/322, 287, 289, 331, 332, 275.11

[56] References Cited

U.S. PATENT DOCUMENTS

| | | | |
|---|---|---|---|
| 1,920,075 | 7/1933 | Haenichen | 102/289 X |
| 2,279,416 | 4/1942 | Snelling | 102/30 |
| 3,090,196 | 5/1963 | Brewer | 102/289 X |
| 3,140,663 | 7/1964 | Rumbel et al. | 102/289 |
| 3,451,341 | 6/1969 | Dittmann | 102/318 |
| 3,678,854 | 7/1972 | Davidson | 102/289 X |

FOREIGN PATENT DOCUMENTS

| | | |
|---|---|---|
| 461381 | 8/1913 | France . |
| 22939 | 6/1902 | Switzerland . |

*Primary Examiner*—Peter A. Nelson

*Attorney, Agent, or Firm*—Stevens, Davis, Miller & Mosher

[57] ABSTRACT

A cylindrical housing for a shock-augmenting charge is provided with axially extending grooves in its outer wall to enhance its radial detonation capability. When used in a cylindrical warhead for augmenting detonation of a main charge of insensitive high explosive, full detonative output is enabled and in addition, a flatter detonation wavefront is generated within the main charge, thereby reducing the need for supplementary waveform shapers.

4 Claims, 4 Drawing Figures

SHOCK-AUGMENTING CHARGE WITH AXIALLY-GROOVED BOOSTER HOUSING

Figure 1:
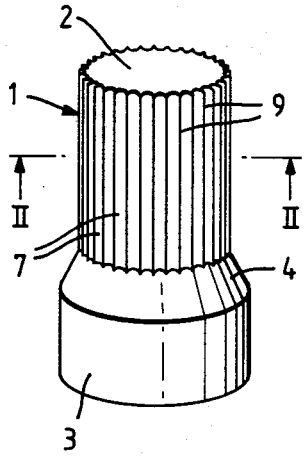

This invention relates to a shock-augmenting charge, ie a booster charge, for use in initiating detonation of a main charge of high explosive material.

For reasons of safety in handling, the high explosive fillings used in warheads for conventional munitions such as shell, torpedoes, bombs and missiles are normally fairly insensitive to shock. Consequently these fillings cannot readily be initiated by the shock wave from conventional detonators and it is necessary to place a booster charge of an explosive material of higher shock-sensitivity between the detonator and the filling, so as to augment the shock stimulus generated by the detonator to an extent that is sufficient to exceed the shock initiation threshold of the less shock-sensitive filling. This shock initiation threshold is a function of the energy that needs to be deposited in the filling material by the applied stimulus and is dependent upon both the intensity and the duration of the impacting pressure.

Typically, a booster charge for an explosive main charge of cylindrical form is located in a cylindrical housing which is coaxially inserted into an axial recess at one end of the main charge, a small annular space being provided between the housing and the recess walls in order to minimise risk of comminution of the main charge and consequent generation of explosive dust which may be more sensitive than the charge itself. A detonator is disposed at the outer end of the booster charge.

When the detonator is initiated, the resulting detonation of the booster charge causes the booster housing to expand and impact the surrounding main charge. In general, the shock stimulus imparted by a housing of such geometric form is greater in the axial direction than in the radial direction and detonation of the main charge consequently tends to initiate at the inner end of the axial recess. When the main charge is comprised by an explosive of particularly low shock sensitivity, eg some types of plastics material bonded explosives, within which there is reduced ability for detonation fronts to turn corners, the region of main charge located rearwards of the initiation point, ie the region circumjacent the booster housing tends to remain undetonated, the axially imparted detonation front being unable to turn backwards and the shock stimulus imparted by the booster charge in a radial direction being insufficient to cause detonation. This effect results in a diminished detonative output from the main charge.

The present invention seeks to provide a shock-augmenting charge having improved radial shock stimulus capability.

In accordance with the present invention a shock-augmenting charge for use in initiating detonation of a cylindrical charge of a first explosive material having one end provided with a coaxial cylindrical recess; said charge comprising a cylindrical booster housing coaxially locatable in the recess in spaced relationship from the charge, having a closed first end and an open second end respectively locatable so as to face inwardly and outwardly of the recess, and containing a cylindrical booster charge of a second explosive material having a higher shock-sensitivity than the first explosive material, exposable in use to a detonation means via the second end of the housing; is characterised in that the booster housing has a cylindrical outer surface provided with a multiplicity of axially extending grooves disposed around its circumference so as to define a corresponding multiplicity of radially projecting impact ridges.

Preferably the grooves extend throughout the whole length of the booster housing and are parallel with the axis of the housing.

The impact ridges are preferably sharply crested so as to provide maximum impact pressure concentration.

Figure 2:
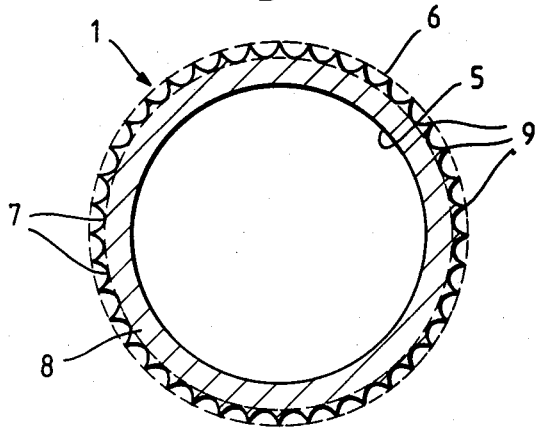
Figure 3:
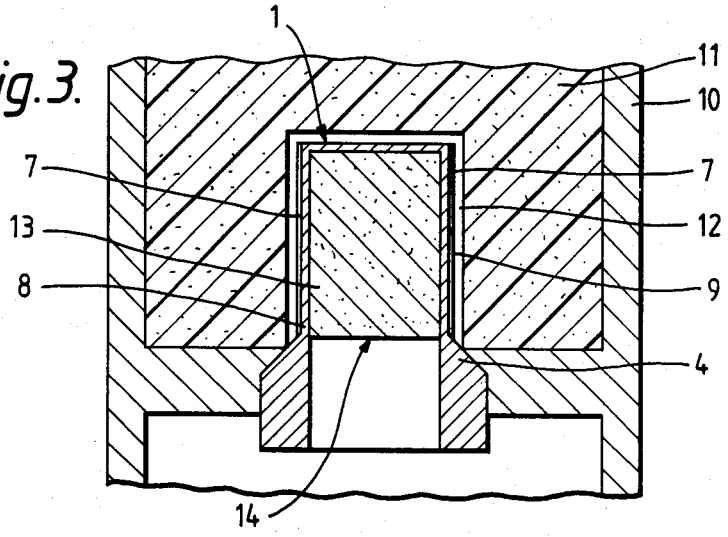
Figure 4:
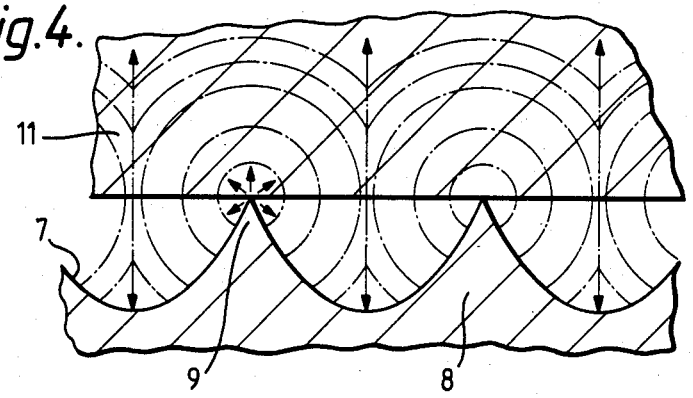

An embodiment of the invention will now be described by way of example only, with reference to the accompanying drawings of which FIG. 1 is a side view of a cylindrical booster housing provided with a multiplicity of axially parallel grooves in its outer wall, FIG. 2 is a section taken on the line II—II of FIG. 1, FIG. 3 is a diagrammatic axial section of the same booster housing located in a cylindrical warhead, and FIG. 4 is a diagrammatic representation of the detonation waves generated upon impact at the housing/main charge interface of FIG. 3.

The booster housing illustrated in FIGS. 1 and 2 comprises a cylinder 1 of an aluminium alloy material, having a closed end 2 and an open end 3 provided with an annular spacing shoulder 4. The cylinder 1 has a smooth bore 5 of 20 mm radius and an outer surface 6 of 23 mm radius, which surface is provided with forty evenly spaced axially parallel grooves 7.

Each groove 7 has a U-shaped cross section which is 1 mm in depth and has a width of 1 mm at its base and of 3 mm at the outer surface 6, thereby defining an inner cylinder portion 8 of reduced wall thickness from which forty sharply crested impact ridges 9 extend radially to the outer surface 6.

The booster housing is assembled for use as illustrated in FIG. 3, which depicts a warhead 10 containing a cylindrical main charge 11 having an axial end recess 12 in which the cylinder 1 is located in co-axially spaced relationship by the shoulder 4.

Contained within the cylinder 1 is a booster charge 13 having an end face 14 disposed for initiation by a conventional detonation arrangement (not shown).

In use, when detonation is initiated, a detonation front advances from the face 14 along the length of the booster charge 13 causing each contemporaneously circumjacent zone of the inner cylinder portion 8 to expand rapidly, thereby forcing the impact ridges 9 radially outwards to impact the surrounding main charge 11. Application of impact pressure thus advances along the lines of the ridge/main charge interfaces with the advance of the detonation wave through the booster charge.

It has been found by experiment that radial impact pressures of sufficient intensity and duration to exceed the shock initiation threshold of a main charge comprised by TATB:Kel-F800/95:5, can be generated in this embodiment using conventional booster explosive material for the booster charge 13, with the result that the whole of the main charge circumjacent the booster housing is detonated, thereby ensuring that the full detonative output of the main charge is achieved.

The booster housing of the present invention is quintuply advantageously over a smooth-walled cylindrical booster housing of comparable internal and external dimensions in that:

(1) The same extension of outer radius needed to engage with the surrounding charge is accomplished more rapidly because an effectively thinner-walled cylinder is being expanded by the same detonation energy;

(2) The impact pressure is locally intensified by being concentrated along selected impact interfaces 9/11;

(3) The circumferential separation of these impact interfaces 9/11 permits the shock wavefront induced at each interface (see FIG. 4) to expand and progress through one half of a groove width in the circumferential direction of the housing before meeting an opposing similar wavefront from the next adjacent interface, thereupon to generate an additional shock stimulus which acts tangentially to the two wavefronts, ie radially in the axial plane of symmetry of the groove, thereby providing a shock focussing effect;

(4) It is also possible that further radial enhancement accrues from regions of higher temperature generated interjacent each neighbouring pair of impact interfaces 9/11 as a result of adiabatic compression of air trapped in the intervening grooves when impact occurs; and (5) The intensified radial impact pressures of (2) above and the additional radial stimuli of (3) and (4) above all proceed in continuously controlled fashion along the lengths of the impact interfaces and of the groove axial planes of symmetry, throughout the whole period of advance of the prime detonation front through the booster charge.

The two distinct shock effects discussed in (2) and (3) above occur sequentially, thus lengthening the time during which shock stimulus dwells in each zone of progression. It will be apparent to those skilled in the art that the invention is capable of providing varying degrees of radial shock-stimulus enhancement by using differing spacings, configurations and numbers of the impact ridges and grooves. For example, the ridges need not necessarily be sharp-crested, flat topped ridges can be used to provide some degree of enhancement. Further, the ridges need not necessarily extend in a direction exactly parallel with the housing axis, enhancement of radial shock stimulus will also be similarly achieved by grooves cut at a small angle to the axis, ie spirally, provided that the impact ridge/main charge interfaces remain uninterrupted throughout the length of the housing and provided that the diminution of inner cylinder wall thickness in the radial direction is sufficient to promote rapid expansion.

The hardness of the material used for the booster housing can also be increased to provide further increase of the degree of enhancement.

A particular application advantage of the invention is that, by promoting fast, full radial detonation of the region of main charge circumjacent the booster housing, the wavefront of axial detonation advance through the main charge is flatter, thereby reducing the need for subsidiary wave shapers such as are currently used in some warheads.

I claim:

1. A shock-augmenting charge for use in initiating detonation of a cylindrical charge of a first explosive material having one end provided with a coaxial cylindrical recess; said charge comprising a cylindrical booster housing coaxially locatable in said recess in spaced relationship from said charge, have a closed first end and an open second end respectively locatable so as to face inwardly and outwardly of said recess, and containing a cylindrical booster charge of a second explosive material having a higher shock-sensitivity than said first explosive material, exposable in use to a detonation means via the second end of the housing; wherein said booster housing has a cylindrical outer surface provided with a multiplicity of axially extending grooves disposed around its circumference so as to define a multiplicity of radially projecting impact ridges; thereby to enhance radial shock stimulation of the first explosive material circumjacent the booster housing.

2. A shock-augmenting charge as claimed in claim 1 wherein said grooves extend throughout the length of said housing.

3. A shock-augmenting charge as claimed in claim 1 wherein said grooves are parallel with the axis of said housing.

4. A shock-augmenting charge as claimed in claim 1 wherein said impact ridges are sharp-crested.

* * * * *